United States Patent [19]

Hung

[11] 4,417,236

[45] Nov. 22, 1983

[54] OVERLOAD DETECTING DEVICE

[76] Inventor: Michael Hung, 6th Fl., No. 683, Min-Sheng, East Rd., Taipei, Taiwan

[21] Appl. No.: 319,382

[22] Filed: Nov. 6, 1981

[51] Int. Cl.[3] ..... G08B 21/00

[52] U.S. Cl. ..... 340/626; 92/5 R; 177/45; 177/146; 177/208; 340/326

[58] Field of Search ..... 340/626, 611, 614, 326; 177/146, 208, 45; 254/93 R, 93 H; 92/5 R, 5 L

[56] References Cited

U.S. PATENT DOCUMENTS

| | | | |
|---|---|---|---|
| 1,828,022 | 10/1931 | Brand | 177/146 |
| 3,145,375 | 8/1964 | Webb | 340/326 |
| 3,939,316 | 2/1976 | Stropkay | 340/326 X |

*Primary Examiner*—John W. Caldwell, Sr.
*Assistant Examiner*—Daniel Myer
*Attorney, Agent, or Firm*—McCormick, Paulding & Huber

[57] ABSTRACT

An overload detecting and alarm device for hydraulic jack comprises an electronic alarm device and a pressure sensitive switch member connected with the electronic alarm device. The pressure sensitive switch member is inserted into the body of the hydraulic jack and is communicated with the ram cylinder through a duct. This switch member comprises a pressure actuated piston which is normally biased in one direction and a spring plate positioned at another direction. The piston and spring plate act as electric contacts in the switch member and will come into contact each other when an overload fluid pressure is exerted on the piston, thereby inducing the electronic alarm device to produce a warning signal.

6 Claims, 3 Drawing Figures

ALARM
30
255
250
254
240
256
253
251
252
220
20
210
230
211

17
10
11
11
SW2
14
16
15
19
13
220
211
20
30
40
41
18
255
50

OVERLOAD DETECTING DEVICE

BACKGROUND OF THE INVENTION

This invention relates to a safety device for a hydraulic jack and particularly to an overload alarm device for a hydraulic jack.

It is customary to provide a safety device in most high pressure operating equipment or apparatus. FIG. 1 shows a hydraulic jack which has a safety valve 14 provided on the hydraulic fluid line 13 which connects the cylinders 40 and 16. When the hydraulic pressure in the ram cylinder 16 is extremely high, the valve 15 is closed tightly by the pressure, and the continuously pumped fluid from the cylinder 40 will push against the safety valve 14 which is designed to relieve at a certain pressure and return the fluid to the storage cylinder 11, thereby avoiding the formation of excessive pressure in the ram cylinder 16. Although the safety valve is provided, it cannot make the user aware of the existence of an overload on the hydraulic jack. This is still a deficiency required to be fulfilled.

SUMMARY OF THE INVENTION

According to the present invention, an overload detecting and alarm device comprises an electronic alarming system coupled with the hydraulic jack, and a pressure sensitive switch member inserted in the body of a hydraulic jack and communicated with a ram cylinder through a duct. The switch member includes a housing, a pressure actuated first electrical contact member extending through one side of said housing and a second electrical contact member provided at the other side of said housing. The first electrical contact is capable of moving against a bias to contact with the second electrical contact member when a fluid pressure from the ram cylinder acts thereon, thereby causing the electronic alarm system to alarm.

In one embodiment of the invention, the second electrical contact is constructed in the form of a spring contact.

According to another aspect of the invention, the first electrical contact member comprises a conductive bar, and a coil spring mounted co-axially thereon and biasing the bar in one direction. According to a further aspect of the invention, the second electrical contact member is provided on a screw support so that the distance thereof relative to the first electrical contact member can be varied and consequently the pressure setting of said switch member can be adjusted.

The electronic alarm comprises a DC power switching means installed in a pumping lever coupling member; a series-connected RC circuit associated with said DC power switching means for testing said alarm; a first multivibrator means connected with said RC circuit through a set of switching diodes coupled thereto; an LED indicating means connected to said first multivibrator means in association with said DC power switching means; a second multivibrator means coupled with said first multivibrator means through said switching diodes; and an alarm means associated with said second multivibrator means whereby overload detecting and alarm functions are automatically performed therein.

An object of the invention is to provide an overload alarm device for signaling the user the occurrence of an overload condition so that precautions therefor can be made.

Another object of the invention is to provide an overload alarm device which comprises a pressure actuated member connected to the ram cylinder of a hydraulic jack and combined with an electronic alarm system.

These and other objects, features, and advantages of the present invention will be more apparent in the following description of a preferred embodiment with reference to the accompanying drawings.

DETAILED DESCRIPTION OF THE PREFERRED EMBODIMENT

Figure 1:
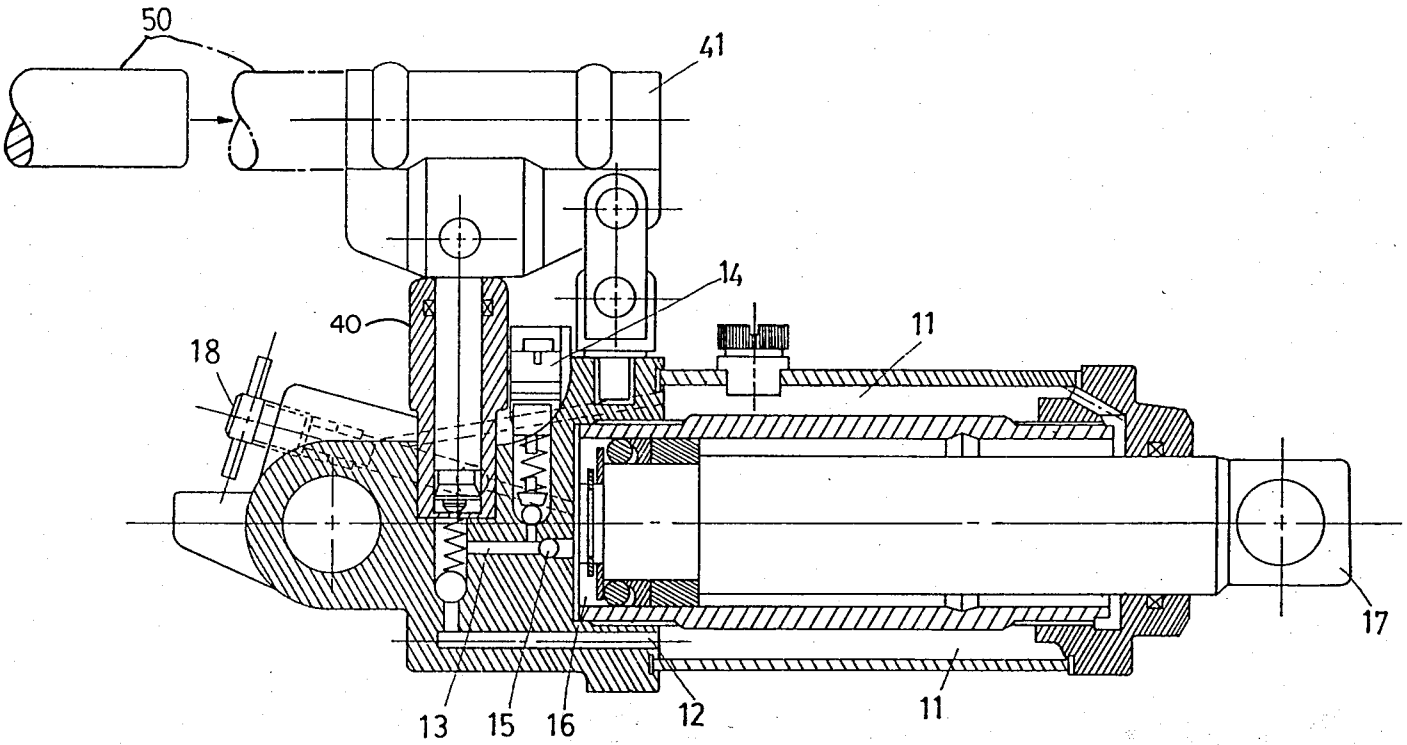
FIG. 1 PRIOR ART
FIG. 1 is a partial sectional view of a conventional hydraulic jack.
Figures 2A, 2B:
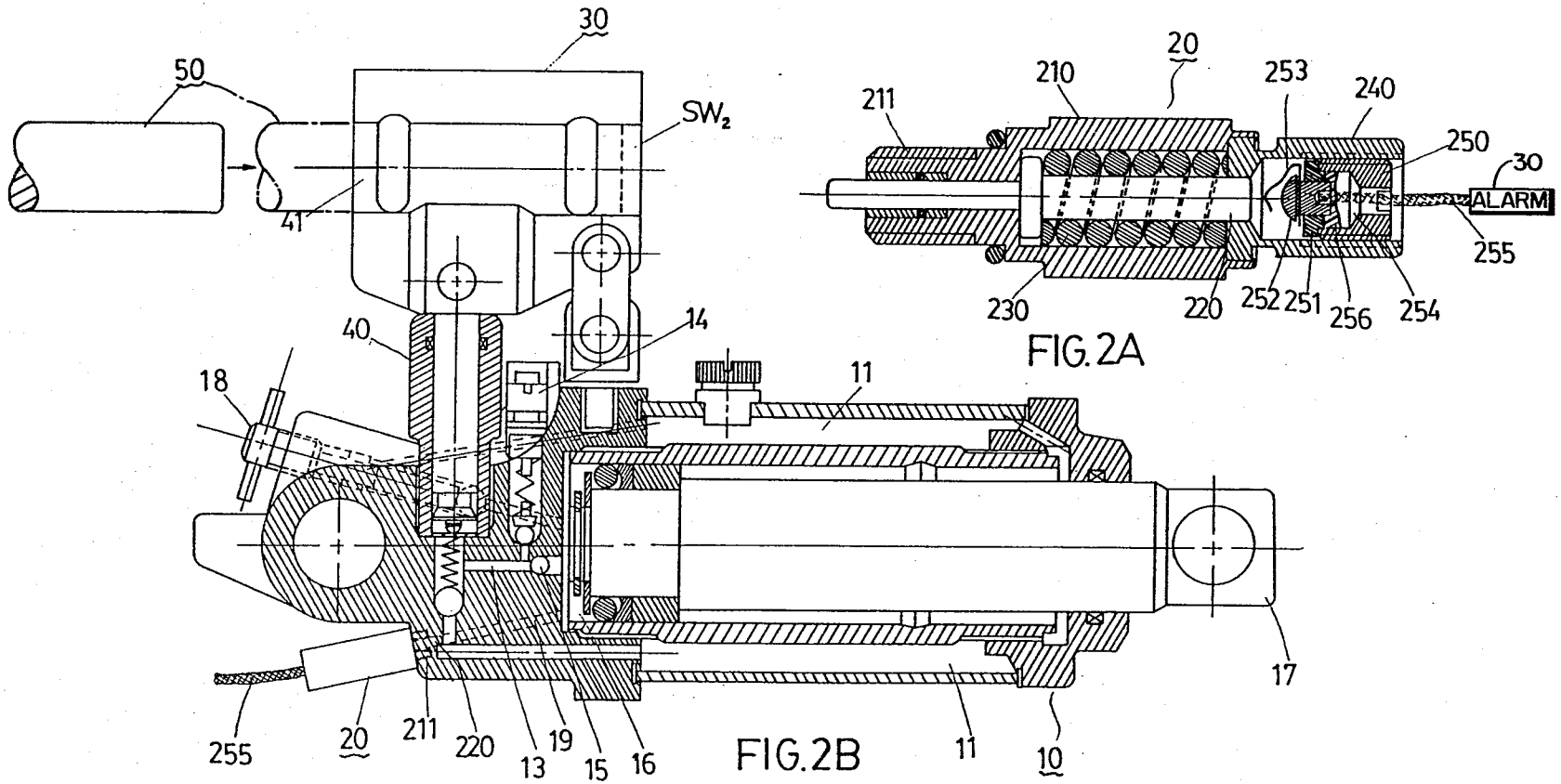
FIG. 2A is a partial sectional view of a pressure actuated switch member constructed according to the invention.
FIG. 2B is a partial sectional view illustrating the position of the pressure actuated switch member of FIG. 2A and an alarm system relative to the hydraulic jack.
Figure 3:
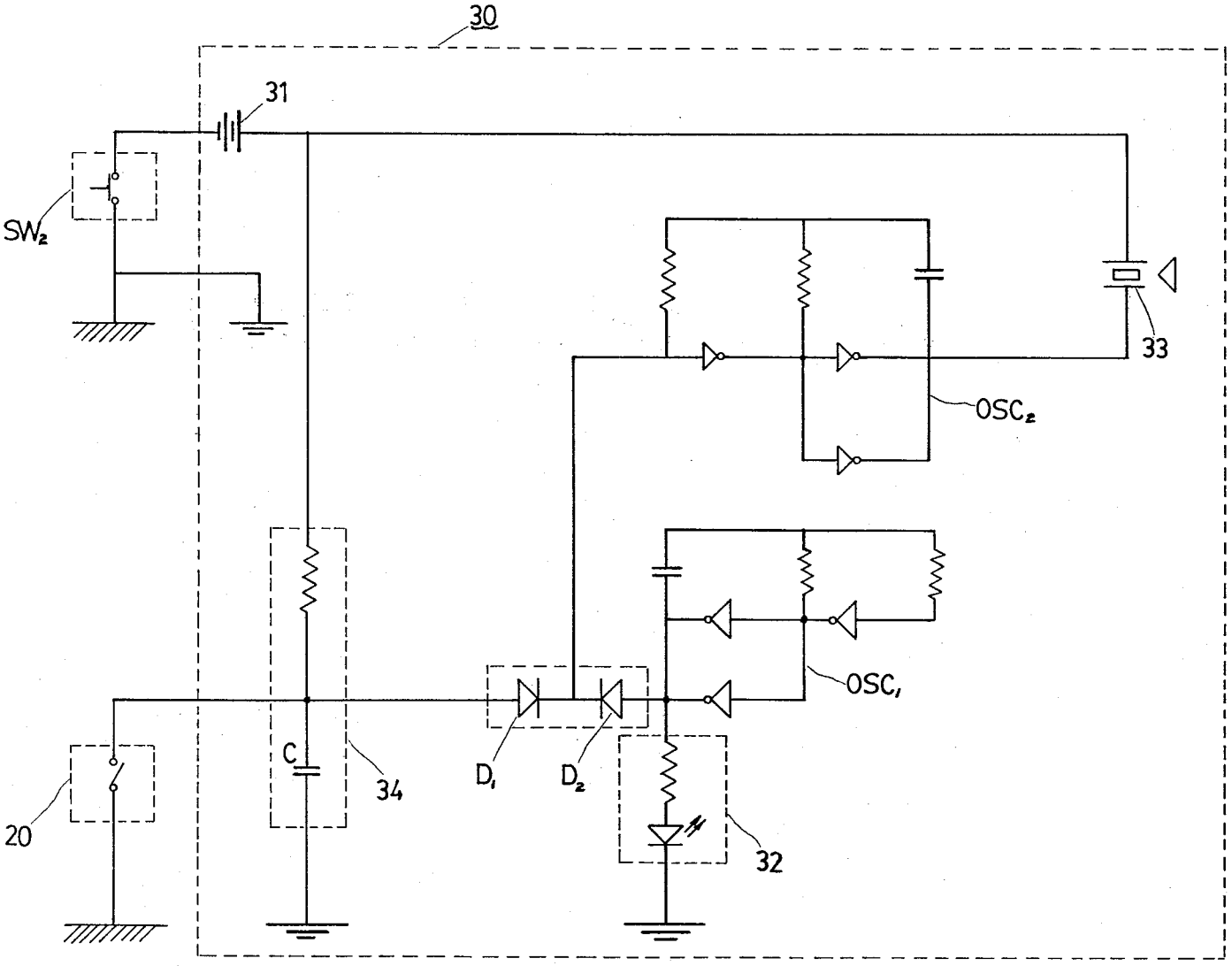
FIG. 3 is a circuit diagram of an overload alarm device according to the invention.

As shown in FIGS. 2A, 2B, and 3, an overload detecting and alarm device according to this invention comprises a pressure sensitive switch member 20 and an alarm system 30 (FIG. 3) controlled by said switch member 20. The pressure sensitive switch member 20 is inserted in the body of a hydraulic jack 10 and is connected with duct 19 from the ram cylinder 16. The switch has a housing 210 and in the housing a pistonlike pressure actuated member 220 is axially provided and extends into the duct 19 through the head portion 211. A spring 230 is mounted co-axially on the pressure actuated member 220 and biases it in a direction towards the duct 19. The spring 230 is so designed that it can allow the pressure actuated member 220 to move against the bias when an overload fluid pressure is exerted thereon. At the rear end of the housing 210 is a casing 240, and a screw support 250 is threadably inserted in the casing 240. The screw support 250 has a hollow section 254 receiving a conductive wire 255 which is connected to a rivet 252. The rivet 252 supports a spring plate 253 and is secured in an insulating plate 251, preferably made of Bakelite, which is bonded to the screw support 250. An epoxy insulating material 256 is used to cover the rear end of the rivet 252.

In the switch member 20, the spring plate 253 and the pressure actuated member 220 act as electrical contacts and will come into contact when the fluid pressure in the ram cylinder 16 reaches an overload pressure and pushes the member 220 against the bias. The position of the spring plate 253 relative to the pressure actuated member 220 can be varied by moving the screw support 250. Accordingly, the pressure setting of the switch member 20 can be thereby adjusted.

The wire 255 extends to and connects with the alarming device system 30 positioned on the pumping lever coupling member 41. The complete circuit diagram of the overload detecting and alarm device is shown in FIG. 3. It comprises a power switch $SW_2$ provided inside the lever coupling member 41 and connected to a DC power source 31. The alarm system 30 further comprises a series-connected RC circuit 34 coupled with the DC power source; a first multivibrator $OSC_1$ connected to the series-connected RC circuit through a set of switching diodes $D_1$ and $D_2$; an LED indicator 32 connected to the first multivibrator $OSC_1$ in association with the DC power switch $SW_2$; a second multivibrator $OSC_2$ connected to the first multivibrator $OSC_1$ through the switching diodes $D_1$ and $D_2$; and an alarm member 33 coupled with the second multivibrator $OSC_2$. This alarm system 30 is placed in a casing and can be placed on the coupling member 41 or at any suitable position on the hydraulic jack.

The detailed operation of the overload detecting and alarm device is hereafter described. When a pumping lever 50 is inserted into the lever coupling member 41 for operating the jack, the switch $SW_2$ is automatically pushed to the ON condition. At that time, the first multivibrator $OSC_1$ starts to act and induce the LED indicator 32 to blink, indicating that the circuit is in operating condition. Meanwhile, the second multivibrator $OSC_2$ also receives the oscillating signal from the first multivibrator $OSC_1$ during the charging period of the capacitor $C_1$ in the alarm detecting circuit 34 and oscillates to make the alarm means 33 produce a temporary high frequency howling. If no LED blinking and alarm is observed from the alarm system 30, it can be taken that the circuit is inoperative and a safety check should be made on the jack.

After ascertaining the operative condition of the alarm circuit, the operation of the hydraulic jack can be started. By operating the lever 50, the hydraulic fluid from the cylinder 11 is gradually pumped into the ram cylinder 16 through the cylinder 40 and the ram 17 will begin to lift the heavy load by means of the fluid pressure. During operation, the pressure in the ram cylinder 16 is continuously transmitted through the duct 19 to the pressure sensitive switch member 20. When the jack is under an overload, the fluid pressure will become greater than the biasing force on the pressure actuated member 220 and therefore will push it against the bias to contact the spring plate 253. As soon as the pressure actuated member 220 and the spring plate 253 contact each other, the alarm circuit 30 will be actuated, i.e., the current which formerly flowed through the switching diode $D_1$ will be conducted to ground. Therefore, the $OSC_2$ under the control of $OSC_1$ will produce a high frequency oscillation, thereby inducing the alarm 33 to howl and warn that the jack is under overload condition.

Upon receiving this overload signal, the lever 50 has to be removed from the lever coupling member 41 to break the circuit, and the pressure release valve 18 may also be opened by means of the lever 50 to let the high pressure fluid in the ram cylinder 16 return to the lower pressure cylinder 11, thereby eliminating the occurrence of the undesired condition.

With the invention thus explained, it is apparent that obvious modifications and variations can be made without departing from the scope of the invention. It is therefore intended that the invention be limited only as indicated in the appended claims.

What I claim is:

1. An overload detecting and alarm device for a hydraulic jack having a coupling member receiving a removable pumping lever comprising, an electronic alarm coupled with the hydraulic jack including power switching means installed in the lever coupling member and actuated by the pumping lever for applying power to the electronic alarm when the pumping lever is inserted in the coupling member;

a pressure sensitive switch operatively connected to the electronic alarm, the switch being inserted in the body of the hydraulic jack and communicating with a ram cylinder through a duct, said switch having a housing, a pressure actuated first electrical contact member extending through one side of said housing into the duct and a second electrical contact member provided at the opposite side in said housing, said first electrical contact capable of moving against a bias to contact said second electrical contact member when a fluid pressure in the second cylinder and duct acts thereon, thereby causing said electronic alarm system to produce an alarm signal.

2. An overload detecting and alarm device as claimed in claim 1, wherein said second electrical contact member is a spring contact.

3. An overload detecting and alarm device as claimed in claim 2, wherein said first electrical contact member comprises a conductive bar, and a spring coil is mounted co-axially thereon and biases said bar in one direction away from said second electrical contact member.

4. An overload detecting and alarm device as claimed in claim 3, wherein said second electrical contact member is mounted on a screw support so that the distance thereof relative to said first electrical contact member can be varied and consequently the pressure setting of said switch can be adjusted.

5. An overload detecting and alarm device as claimed in claim 1 wherein the power switching means comprises a DC power switching means and the electronic alarm further comprises; a series-connected RC circuit connected with said DC power switching means for initially testing the alarm; the RC circuit being connected with a first multivibrator means through a set of switching diodes coupled therewith; an LED indicating means connected to said first multivibrator means in association with said DC power switching means; a second multivibrator means coupled with said first multivibrator means through said switching diodes; and an alarm means connected with said second multivibrator means whereby overload detecting and alarm functions are automatically performed therein.

6. An overload detecting and alarm device for a hydraulic jack comprising an electronic alarm system coupled with the hydraulic jack including a DC power supply and a DC power switching means connected with the DC power supply for activating and deactivating the electronic alarm; a series-connected RC circuit associated with said DC power switching means; a first multivibrator means connected with said RC circuit through a set of switching diodes coupled therewith; an LED indicating means connected to said first multivibrator means in association with said DC power switching means; a second multivibrator means coupled with said first multivibrator means through said switching diodes; and an alarm means associated with said second multivibrator means whereby overload detecting and alarming functions are automatically performed therein; a pressure sensitive switch member inserted in the body of a hydraulic jack and communicated with a ram cylinder through a duct, said switch member being connected to the RC circuit to signal an overload and having a housing, a pressure actuated first electrical contact member at one side of said housing and a second electrical contact member at the other side of said housing, said first electrical contact being capable of moving against a bias to contact said second electrical contact member when a fluid pressure acts thereon, thereby causing said electronic alarm system to produce an alarm signal.

* * * * *